US007341473B2

(12) United States Patent
Gaidosch

(10) Patent No.: US 7,341,473 B2
(45) Date of Patent: Mar. 11, 2008

(54) CONTACT ELEMENT AND ADDITIONAL CONDUCTION CHAMBER FOR A PLUG OR SOCKET

(75) Inventor: Othmar Gaidosch, Ostfildern (DE)

(73) Assignee: Hirschmann Automation and Control GmbH, Neckartenzlingen (DE)

( * ) Notice: Subject to any disclaimer, the term of this patent is extended or adjusted under 35 U.S.C. 154(b) by 0 days.

(21) Appl. No.: 10/559,526

(22) PCT Filed: May 4, 2004

(86) PCT No.: PCT/EP2004/004689

§ 371 (c)(1),
(2), (4) Date: Jun. 5, 2006

(87) PCT Pub. No.: WO2004/105185

PCT Pub. Date: Dec. 2, 2004

(65) Prior Publication Data

US 2007/0099476 A1 May 3, 2007

(30) Foreign Application Priority Data

May 26, 2003 (DE) ..... 103 23 615

(51) Int. Cl.
*H01R 11/20* (2006.01)

(52) U.S. Cl. ..... 439/404

(58) Field of Classification Search ..... 439/393, 439/395–408, 417, 443
See application file for complete search history.

(56) References Cited

U.S. PATENT DOCUMENTS 3,860,318 A * 1/1975 Reavis et al. ..... 439/406
3,955,873 A * 5/1976 Peterson ..... 439/401
3,964,816 A * 6/1976 Narozny ..... 439/397
3,980,380 A * 9/1976 Cieniawa et al. ..... 439/404
3,990,767 A * 11/1976 Narozny ..... 439/406
4,011,647 A * 3/1977 Peterson ..... 29/750
4,624,521 A * 11/1986 Vachhani ..... 439/396
4,664,699 A * 5/1987 Ahle ..... 504/107
4,960,389 A * 10/1990 Frantz et al. ..... 439/404
4,969,839 A * 11/1990 Nilsson ..... 439/395
5,071,366 A * 12/1991 Bernardini ..... 439/417
5,273,443 A * 12/1993 Frantz et al. ..... 439/595
5,305,547 A * 4/1994 Weiss ..... 439/395
5,439,388 A * 8/1995 Weiss et al. ..... 439/417
5,522,733 A * 6/1996 White et al. ..... 439/395
5,662,492 A * 9/1997 Weiss ..... 439/404
5,810,616 A * 9/1998 Ivey ..... 439/395
5,954,541 A * 9/1999 Ozai et al. ..... 439/608
6,241,549 B1 * 6/2001 Saka et al. ..... 439/395
6,280,229 B1 * 8/2001 Harting et al. ..... 439/393
6,544,067 B2 * 4/2003 Hagmann ..... 439/404
6,676,436 B2 * 1/2004 Gaidosch ..... 439/393
6,688,920 B2 * 2/2004 Lehner et al. ..... 439/748
2002/0031937 A1 * 3/2002 Hagmann ..... 439/404
2004/0029431 A1 * 2/2004 Comini ..... 439/417

* cited by examiner

*Primary Examiner*—Ross Gushi
(74) *Attorney, Agent, or Firm*—Andrew Wilford

(57) ABSTRACT

A contact (1) for a plug or socket of a quick-connect plug connection, the contact (1) being held mounted in a contact holder (2) having a region for press-fit gripping a conductor, a wire holder (7) having at least one wire seat (7.1) for the end of a wire and the contact (1) engages the wire in the wire seat (7.1), where according to the invention the contact (1) has at least two press-fit arms (1.4) of curved and/or polygonal section that contact the wire generally axially.

10 Claims, 4 Drawing Sheets

CONTACT ELEMENT AND ADDITIONAL CONDUCTION CHAMBER FOR A PLUG OR SOCKET

CROSS REFERENCE TO RELATED APPLICATIONS

This application is the US national phase of PCT application PCT/EP2004/004689, filed 4 May 2004, published 2 Dec. 2004 as WO 2004/105185, and claiming the priority of German patent application 10323615.5 itself filed 26 May 2003.

TECHNOLOGICAL FIELD

The invention relates to a contact and to a complementary wire seat for a plug or a socket utilizing the plug connection in quick-connect technology and particularly in insertion-piercing connecting technology according to the features of the preamble of claim 1.

STATE OF THE ART

An important trend in plug connection technology or cable connection technology is the permanent electrical connection between insulated electrical conductors and corresponding contacts of plug-and-jack connecting devices, apparatus housing, sensory-effector modules, printed circuit board modules and the like in the most rational manner possible, that is with a minimum of cost in time and financially. An important requirement here is that the connection procedure be carried out without the need for additional tools, manually and as much as possible without defect or errors in the connection. In conjunction with this requirement, for example, concepts like "rapid contacting" for quick-connect technology have been developed. The most important contact technology in this field is the insulation-penetrating connection technology in insulation piercing connecting technology or insulation piercing terminal technology, penetration technology, clamping jaw technology and spring-contact technology. A further, very important trend that has contributed to the general technological development in this field is the formation or use of plug connectors and cable-connecting devices that contribute to miniaturization while as a rule maintaining the power aspects of the connector.

One of the important solder-free electrical connections is the press-fit clip connector. EN 60352-3 defines a solder-free connection that is produced by pressing a single wire into a slit provided with precision in a terminal, whereby edges of the press-fit clip cut through the insulating jacket of the conductor and deform the round massive conductor or single wire of the conductor or lead and thereby produce a gas-tight connection. A highly advantageous feature of the press-fit clip is that (metallic) press-fit clip flanks apply the contact force to the metallic conductor symmetrically, that is free from the application of torque, and permanently elastically at a right angle to the wire; creep and relaxation effects are negligible as a result of the workpiece characteristic, as is a loss of the spring force between the metals. By comparison with penetration techniques that only apply to stranded wire conductors, the press-fit clip have the advantage that they can make contact both with solid core and as with stranded-conductor wire. In their known form, an insulation-penetration terminal is so provided that the longitudinal axis of the massive conductor or stranded wire lies perpendicular to a plane defined by the flanks of the insulation-penetration terminal. This means that the entire cable must be generally perpendicular to the plug direction of the plug connector. To the extent required, under these conditions, an alignment between the cable end and the plug direction can only be achieved by a bend, that is taking up additional room and as a rule at additional cost.

A number of tests have been undertaken for the production of plug connectors with insulation-piercing terminals in which the cable is oriented in line with the plug-in direction; in this manner it was hoped to minimize the above-mentioned additional cost or drawbacks. Basically, in this case, either the axis of the electrical conductor was set at an acute angle to the line of the cutting terminal flanks or the cutting terminal was angled at the end region of its slit and via wedge elements, usually elastic or resilient, have the conductor pierced into it (for example DE 100 26 295 or EP 1 158 611).

With the known round plug connectors (plugs or sockets), it has been felt that such plug arrangements could not be readily created with a central contact, since the partial circles or circular segment was defined by the position of the outer contact and must surround the central contact at a relatively small distance and the dimensions must be relatively small to accord with standards. Because of the basic configuration of known press-fit clips and the wire seats provided for them in the appropriate insulating bodies, the place for a central terminal is limited and thus the spectrum of use for such plug connectors is narrowed.

The insulation-penetrating clip or the press-fit arms are straight or planar. In order to generate the requisite contact force, the press-fit clip must be relatively wide in the elastic or spring direction and thus configured to be relatively bulky. This drawback is reinforced because of the place or location consideration for the terminal since the press-fit clip for functional reasons must be perpendicular to the plane in which the conductor wires for the purposes of making contact must be laterally bent or set at an inclination (as for example in EP 1 158 611). A further disadvantage to flat press-fit clips is that they are generally inserted in corresponding channels in the insulating body that also contains the wire seat in which the bends of the conductor wires are contained. These channels fix the press-fit clips in position and ensure that the cutting flanks of the terminal upon penetration of the wire insulation will not in turn be pressed by the wire to the sides. As a result of the reduced contact surfaces that the press-fit clips have in the spring direction, large surface forces develop against the side wall of these bodies that among other things can lead to their damage. This effect has been found especially negative in the case of press-fit clips that are punched out and thus may have rough lateral edges that may have punching burrs.

With plug connectors, plug or socket arrangements of equipments or devices, sensor/effector modules and the like, one deals with electronic components or operating elements that have minimum requirements with respect to the dimensions of or gaps or current-creep paths between electrically conducting parts of different potentials (EN 50178). This standard provides that the finishing tolerances in the mounting and connection of the electronic units (EB) must be considered. In addition, larger spacings and creep paths must be provided especially when the incorporation or connection of the EB takes place before mounting or during mounting or is not altered or when the wiring is carried out anew or is changed during the mounting. The dimensioning of the spacings and creep paths must be considered in light of an expected reduction in them during the operational conditions in the expected environment. These criteria are of great significance especially with respect to the voltage-supplying end of the relatively easily bendable conductor wires and their relatively imprecise lengths.

DISCLOSURE OF THE INVENTION

The invention has as its object the provision of a contact and, in addition, of a wire seat complementary thereto for a plug or a socket of a plug connector in accordance with quick-connect technology and that operate in accordance with the principles of press-fit clip contacts that can avoid the drawbacks described previously.

This object is attained in accordance with the features of patent claim 1.

According to the invention the contact has as at least two press-fit arms that have in cross section a curved and/or polygonal configuration and contact the conductor wires in approximately an axial direction. Press-fit clips with such curved or polygonal flank cross sections, have, apart from the advantage of an especially compact construction, the substantial advantage that for a given spring stiffness or spring constant they have substantially more reduced dimensions in the spring direction than known planar penetrating or cutting terminals that contact the conductor wires generally at a right angle. With such penetrating or cutting terminals, moreover, a plug or socket can be provided for a plug connector in press-fit clip technology that from the aspect of contacting and contact reliability has substantially better properties and in addition a more compact structure than the known plug connector. The shape of the arms of the press-fit clip is reproduced in a wire holder that has wire seats into which the ends of the wires are inserted and there fixed. After insertion of the wires into these wire seats, the press-fit clips are installed axially n the wire holder, that is each press-fit clip contacts a resp wire end. To this end it is further provided according to the invention that the press-fit arms are at least partially fixed nonmovably in the wire holder. In other words the wire holder partially receives the pressure applied during contacting by means of the press-fit clips so that as a result bending pr spreading of the press-fit arms when connected is effectively prevented.

In the following the contact according to the invention and also the complementary wire seat are described more closely with reference to an embodiment, to which the invention is not limited, with reference to the figures.

BRIEF DESCRIPTION OF THE DRAWING

Therein.

EMBODIMENTS OF THE INVENTION

Figure 1:
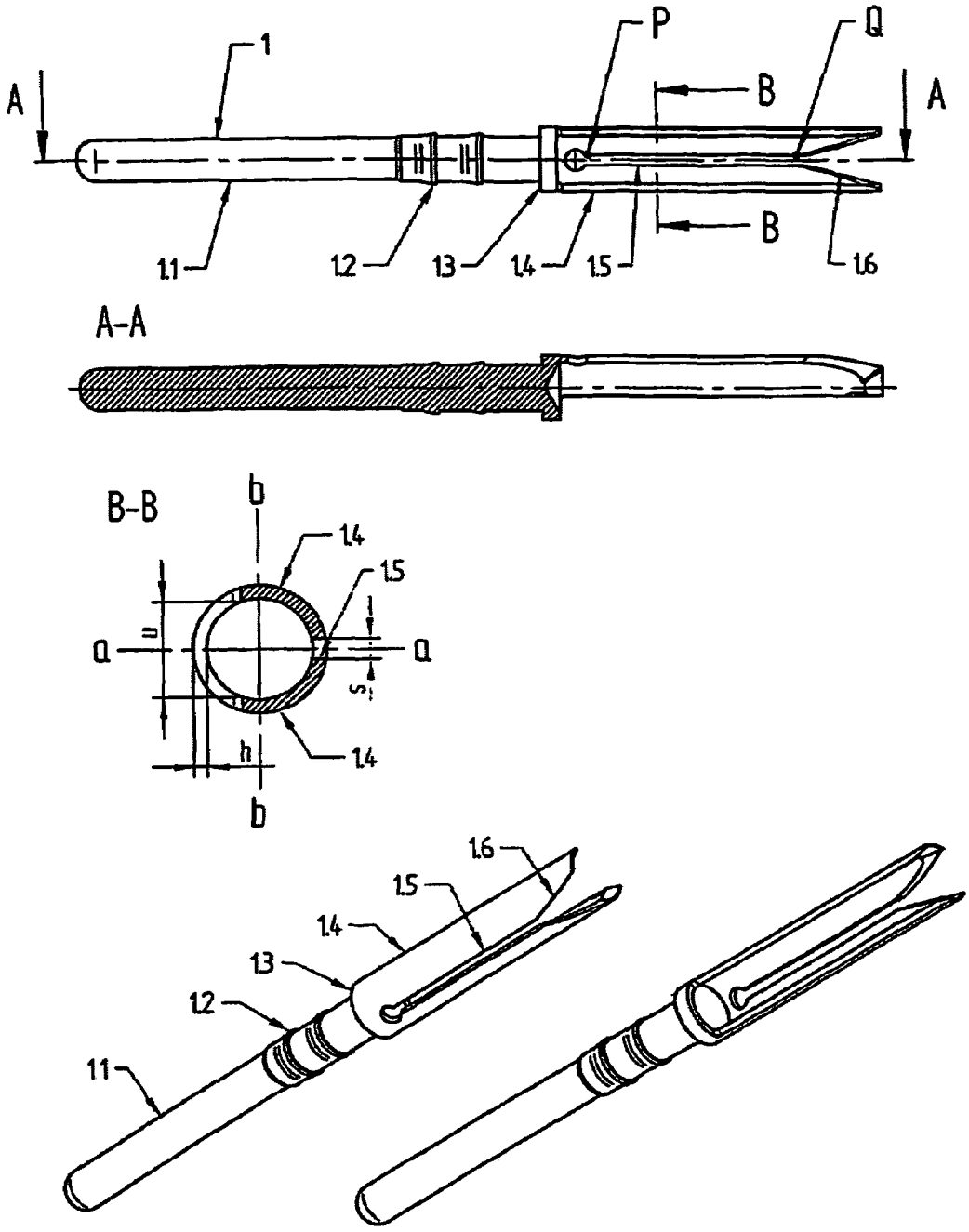
FIG. 1 is several views showing the structure of a contact.

FIG. 1 shows an electrical contact 1 that is formed as a contact pin 1.1 extending in the connection direction of the plug but that can also be formed as a contact sleeve, hybrid contact, printed-circuit contact, solder terminal, or the like. For mounting in an insulated holder, the contact 1 has projections 1.2 that if needed to prevent rotation can also have longitudinally extending parts (e.g. ridges). To aid in mounting (as abutment) and to resist the force of press-fit there is a shoulder 1.3. The contact 1 has press-fit arms 1.4 forming a press-fit terminal and extending parallel to the conductors, the intervening slots 1.5 having a width s and entry bevels 1.6 that serve on the one hand to center the conductor and the other hand to reduce the insertion force. The press-fit arms 1.4 shown here are of ring-segmental section constructed such that the dimension u is equal to or slightly less than the diameter D of the wire to be contacted. In another extreme case this press-fit clip can be constructed such that u=s, providing double cutting-clamping action. In addition the ring-segmental shape is only one of many shapes according to which the cross-section of the press-fit arms is arcuate, here for example elliptical. It is also possible to use a polygonal section, each arm in this case being of L-section (for simple cutting/clamping action) or C- or U-shaped for double cutting/clamping action). Press-fit clips with such arcuate or polygonal arm sections have the considerable advantage that in a very compact space they have the same spring grip as much larger flat press-fit clips. It is also possible to use a combination of arcuate and polygonal sections (e.g. a slot shape). In a further important embodiment a press-fit slot 1.5 between two press-fit arms 1.4 is of the same width along its entire length and/or at least partially of increasing and/or decreasing width. Thus the slot 1.5 has for example a straight, stepped, wavy, or sinusoidal shape. A further interesting aspect of all these embodiments is when the slot width s is not constant along the slot, but variable, in particular V-shaped so that the slot is slightly smaller at its base than at the entry bevels 1.6: $s_P<s_Q$. This shape is above all useful in contacts where the conductor extends at a small acute angle to the press-fit slot since in this case there is a longer contact region than with transversely extending conductors. Since the relationship between the diameter of the conductor and the width of the slot of the press-fit clamp is directly related to the contact quality, such a V-slot is possible that can accept skinnier conductors at the slot base (point P) than further out so that the scope of application of such a press-fit clamp is correspondingly increased. In addition it is above all possible with stamped press-fit clips to improve the quality of the contact and/or increase the application scope relative to the conductor diameter to make the slot edges nonstraight, but for example to shape them as very flat sinusoids or flatly merging steps or the like whereby as above the slot width s is either constant or varying. With these systems fitting of the conductors is easier and at the same time with press-fit contacting a longitudinal pulling-out of the wires is effectively prevented. In addition the orientations of the edges having the dimension h of the press-fit slot 1.5, of the entry bevels 1.6, and of the press-fit arms 1.4 relative to the axes a-a and b-b (see FIG. 2, section B-B) can be the same and/or vary at least partially. This orientation can, as for example shown at the dimension s be parallel to the axis a-a, as for example at the dimension u be parallel to the axis b-b, or be oriented between these two limits. Similarly the dimension h can be made variable along these limits, at least partially the same and/or at least partially variable so as to optimize the press-fit action.

Figure 2:
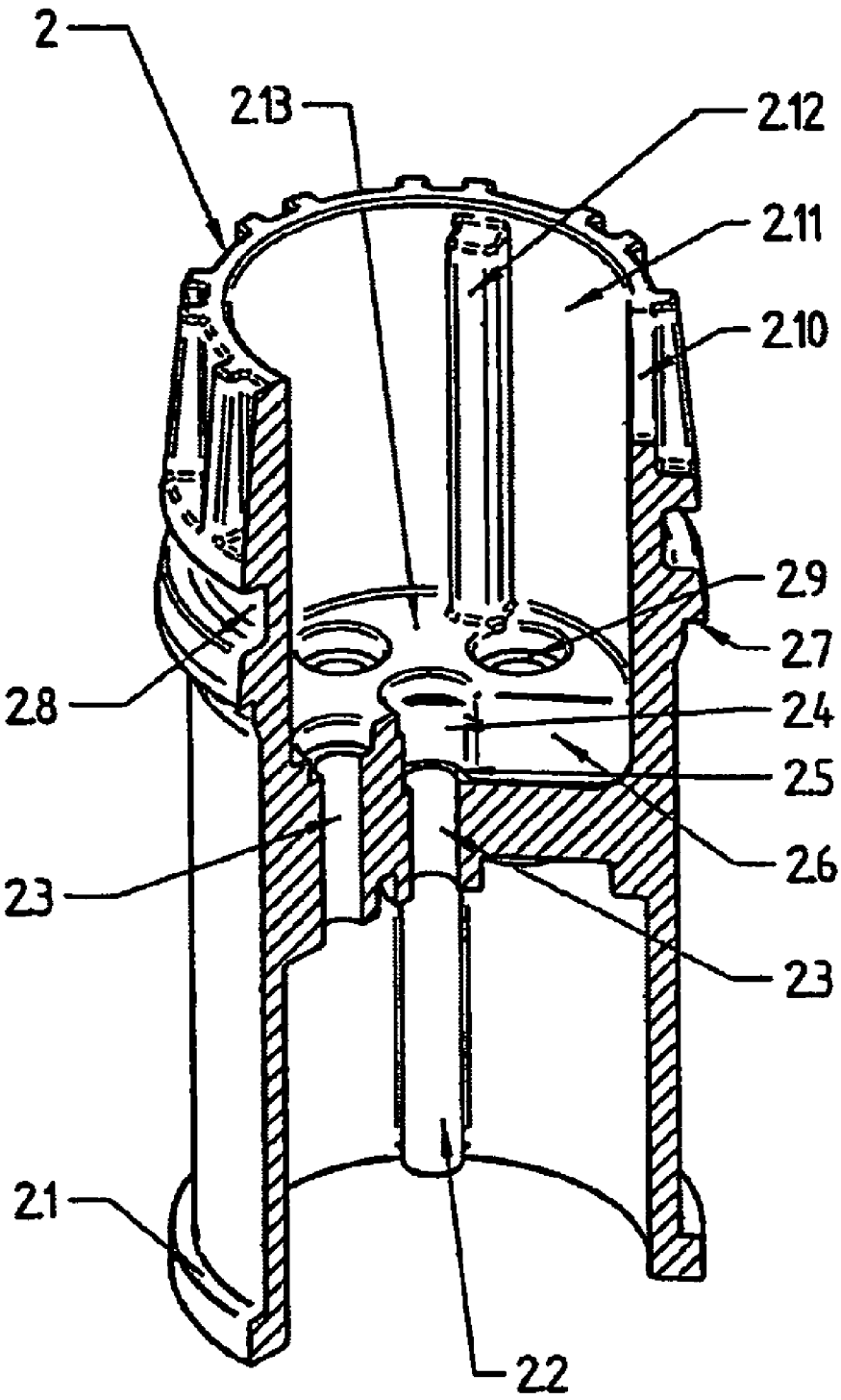
FIG. 2 is a view of a contact holder for receiving at least one contact according to FIG. 1.

FIG. 2 shows a contact holder 2 formed of electrically insulating material and having a support rim 2.1 for the coupling element 3, a coding or twist preventer 2.2, and holder bores 2.3 in which the contacts 1 are press-fitted in defined positions (for example by injection molding). Support surfaces 2.9 are provided in the bores 2.3 for the contact faces 1.3. Optionally one of the holder bores 2.3, here the center bore, that must be in electrical contact with the metallic casing of the plug is provided with an additional concentric seat bore 2.4 that holds or secures the a here unillustrated contact. The contact holder 2 is formed at this seat bore or the contact with a support surface 2.5 as well as a holder or mounting groove 2.6 and a throughgoing slot 2.10. In addition the contact holder 2 has a further abutment rim 2.7, a seal groove or surface 2.8, a guide surface 2.11, a further coding or twist preventer 2.12, and an abutment face 2.13, these formations being necessary for fitting the contact holder in further parts of the plug or socket.

Figure 3A:
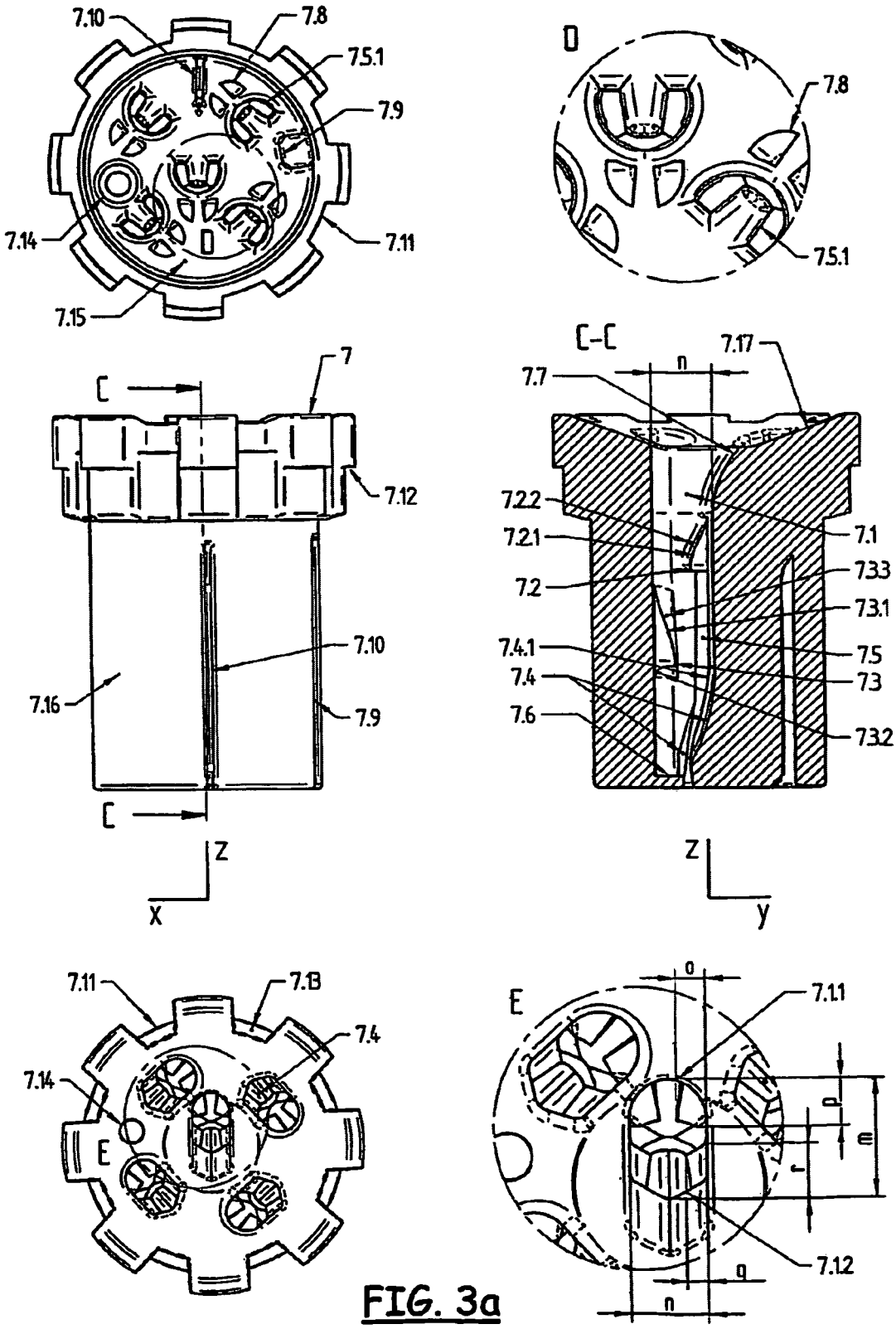
FIGS. 3*a* and 3*b* are various views of a wire holder for receiving the ends of the conductors and the press-fit terminals in the region in which the press-fit contacting takes place.
Figure 3B:
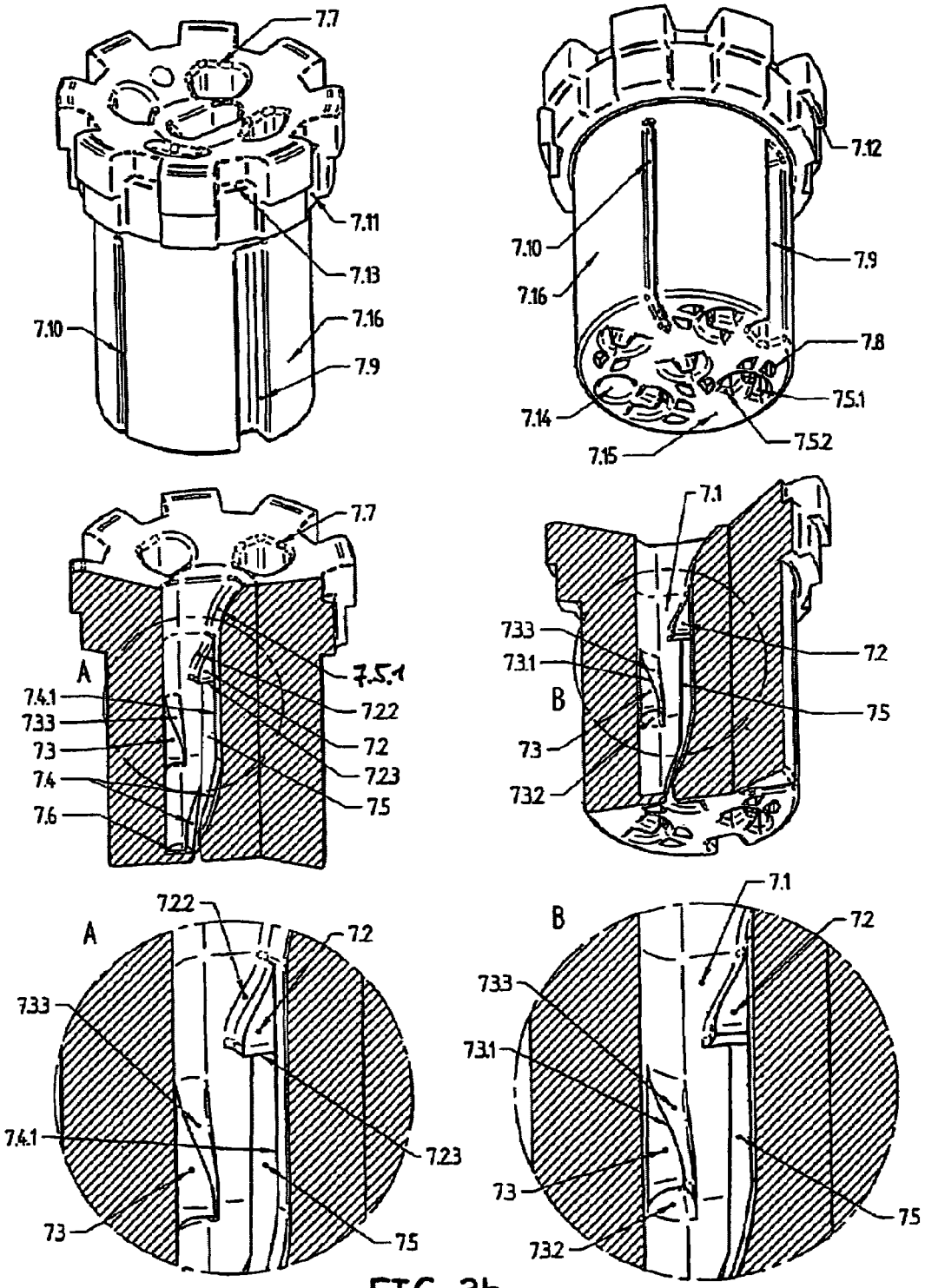

FIGS. 3*a* and 3*b* show various views and sections of a wire holder 7 of electrically insulating material and formed with wire seats 7.1 in which the respective wires are held and positioned for contacting with the respective press-fit clips. The wire seats 7.1 are formed as funnels at one end with wire-guiding entry bevels or roundings 7.7. Further in (direction -z) the shape of the seats 7.1 is at first of uniform cross-section with the area m*n. Here dimension m determines the extent to which the wire is deflected while n is the diameter of the wire so that when inserted into the press-fit clip it cannot slip to the side. At their ends the wire seats each have a deflecting bevel 7.4 that reduces the cross section to that of the end of the wire and this is positioned in an x-y projection exactly relative to the press-fit clip such that the y dimension of the conductor 16.2 is for a solid electrical contact smaller than the y dimension of the slot of the press-fit clip. This positioning ensures that the clip cuts into the end of the wire and also uses space efficiently. In the opposite direction the dimension m is such that the x-y projection of the metallic conductor clearly runs across the press-fit clip. As a result of the fact that the diameter of the metallic conductor is inherently smaller than the conductor diameter D, there is certain contact satisfying the relationship m<2D. At the end of each wire seat 7.1 there is another abutment face 7.6 that ensures that a current-conducting conductor cannot poke through the wire seat 7.1. At the same time this face 7.6 forces the conductor end in the z-direction into an exact position in the press-fit clip. Whereas the cross section of the wire seat 7.1 has flat faces defining the width n, it tapers in the region with dimension m either to a somewhat curved, semicircular shape 7.1.1 or into a polygonal or V-shape 7.1.2. These ends can of course also have the same shape. This shape can be maintained over the deflecting face 7.4 to the abutment face 7.6 in the same or a similar manner. This tapering is above all significant with conductors having a smaller diameter than the seat width n, so as to center the conductors when they are deflected on a center plane of the wire seat 7.1. In addition it is important that the wire seat has means that deflect the wires when fitted to the wire seats 7.1 out of their longitudinal orientation. This is embodied in that the means is formed by projections or ribs that are set next to one another axially and/or angularly. More specifically there is inside each of the seats 7.1 one or more, in particular two deflecting ribs 7.2 and spaced along the z-axis one or more and here two deflector ribs 7.3. These deflecting ribs 7.2 and 7.3 are provided with relatively flat flanks 7.2.1 and 7.3.1 extending in the wire-feed direction so as to prevent hooking on the wires and reducing the friction during assembly. Furthermore the deflecting ribs 7.2 and 7.3 have along these angled flanks in their x- and y-dimensions further flanks 7.2.2 and 7.3.3 that work like the seat restrictions 7.1.1 and 7.1.2 for centering skinnier conductors. For this effect the flanks 7.2.2 and 7.3.3 are according to the number and distribution of the deflecting ribs 7.2 and 7.3 differently shaped along the seat dimension n so that, as shown for example with the flank 7.3.3, they have a variable angle. The deflecting rib or ribs 7.3 have toward the abutment 7.6 a further flank 7.3.2 that also centers the end of the conductor, above all during backward deflection during deflection into the press-fit clip. With respect to the actual shape of these flanks 7.3.2 the same is true as for the flanks 7.2.2 and 7.3.3. The abutment 7.1, the deflecting flank 7.4, and the deflecting ribs 7.2 and 7.3 are so spaced along the z-axis that it is possible to push the conductor into the wire seat 7.1 with a relatively small force. A further important part of the wire seat 7.1 is the guide surface 7.5 that serves to guide the press-fit arms 1.4 and above all to resist their elastic outward deflection when a conductor is fitted in. The deflection of the guide surface 7.5 in the z-direction is at least as long as the insertion depth of the press-fit clips and ends preferably at the lower flank of the deflecting rib 7.2. Since the deflecting rib 7.3 is located about halfway along the insertion depth, it is sure that the conductor will be engaged at least once and often at two location offset in the z-direction so as to make a very good connection. Like the guide face 7.5, the wire holder 7 has openings 7.5.1 open toward the press-fit arms 1.4 so that the press-fit arms 1.4 can engage into the respective wire seats 7.1.

The outer shape of these openings 7.5.1 conforms either over its entire circumference or only over a part thereof, for example when the press-fit arms 1.4 are supported or guided at specific locations, to the outer shape of the respective press-fit clip while the remaining region is spaced from the press-fit clip. It is important in this regard that the wire holder 7 is made by injection molding so that the x-y projection of the inner shape of the opening 7.5.1 facilitates demolding with the projection of the seat surface 7.4.1 that extends over the deflecting face 7.4 to the deflecting rib 7.2; on the other hand this inner shape corresponds with the lower edge 7.2.3 of the deflecting rib 7.2. The opening 7.5.1 is provided with the entry bevel 7.5.2 that prevents canting of the entering press-fit clip. On the side of the wire holder 7 toward the press-fit arms 1.4 it has at each wire seat 7.1 further openings 7.3 whose number corresponds to the number of deflecting ribs 7.3. It is significant that their shape is larger to allow demolding long the x-y projection of the deflecting ribs 7.3. It is important in any case that the openings 7.3 not be too big so that the smallest possible conductor can be slid through them or the abutment 7.6 would become ineffective. If one is certain that is the x-y projection of the deflecting ribs 7.2 and 7,3 and the deflecting flank 7.4 of the abutment 7.6 do not overlap, the wire seats 7.1 or the entire wire holder can be deformed in a very simple manner along the longitudinal axis z. Further features of the wire holder are the coding or twist preventer 7.9, the guide face 7.16, and the abutment face 7.15 that are important with regard to the contact holder 2. The groove 7.10 serves for holding or guiding the contact 13. The groove-like recess 7.11 also forms a coding or twist preventer for the sleeve 9. The surfaces 7.12 are grip surfaces by means of which the wire holder 7 can be pulled out of the contact holder 2. The wire holder 2 is pressed against the faces 7.13 into the contact holder 2 having the press-fit arms. The test bore 7.14 that extends conically over a portion of its length allows the user to determine if the diameter of the wire to be fitted will go into the wire seat 7.1 of the wire holder 7. The conical surface 7.17 has the function of fixing the contact 8 in the z-direction such that a radial force component is created toward the plug center axis, that is toward the cable shielding. The surface 7.17 can alternatively also be shaped otherwise, for example flat.

In a preferred embodiment that is shown for example in FIGS. 2 and 3, the wire holder 7 has several wire seats 7.1, each wire seat 7.1 holding the end of a conductor that is fit in the press-fit clip with a central conductor seat 7.1 symmetrically surrounded by a plurality of outer wire seats 7.1. Such a system particularly shows the inventive shape of the contact element 1 as shown for example in FIG. 1. The slim elongated shape of the contact element 1 and the mainly axial press-fit contacting with the also axially extending conductor allows, unlike the known press-fit clips according to the prior art and their arrangement in the wire holder, the use of a central contact element and thus a central terminal of a plug or socket. Around this central contact there is a symmetrical arrangement (for example in a square pattern or in a circle) of the other contacts and thus the other terminals of the plug or socket that allows the transmission at high data rates or the transmission of high frequency signals in the megahertz or gigahertz range. This advantageous effect is improved on when the entire socket or plug is shielded (that is the elements that are shown in FIGS. 2 and 3 are set in a metallic casing of the plug or socket) or via a contact element (in particular the central contact there is a shielding or connection to ground).

In the above description the terms "plug" and "socket" intended with the following meaning:

A plug connection can comprise a plug and a socket that are connected together in quick-connect fashion at the end of a cable. serve for electrical connection of the cable by sliding together, screwing together, or the like. Those parts of a plug connection that are joined to a plug can instead of a socket also be called a wire seat, base, or coupling. in addition it is possible that the plug or the socket is not mounted in quick-connect fashion on the end of a cable, but is fixed or releasably mounted on a sensor, an actuator, a piece of equipment, or the like. The terms "plug" or "socket" all are intended to cover any parts necessary n order to plug in a cable. These parts in particular include the contacts that are fixed or fixable in the contact holder, the wire holders, and a casing of the plug or socket in which these named parts are integrated as well as further parts (as for example a connecting nut or connecting screw for screwing on a plug connection, a strain relief, and the like).

The invention claimed is:

1. A quick-connect plug connector comprising:

a tubular contact holder extending along an axis and formed with a transverse partition formed with a plurality of axially throughgoing seat holes;

respective metallic contacts fitted to the holes and extending through the partition, each contact having to a rear side of the partition a pair of generally U-section axially extending arms concave toward each other and separated by an axially rearwardly open split tapering forward toward the partition and to a front side of the partition a contact part; and a wire holder in the contact holder rearward of the partition and formed with respective wire-holding passages dimensioned to receive and grip respective wires with conductors of the wires wedged in the respective splits.

2. The connector defined in claim 1 wherein the arms are of annularly segmental section.

3. The connector defined in claim 1 wherein the arms are of elliptical section.

4. The connector defined in claim 1 wherein the arms are of L-section.

5. The connector defined in claim 1 wherein the arms are at least partially nonmovably fixed in the wire holder.

6. The connector defined in claim 1 wherein the wire passages are provided with formations that deflect the wires into the split between the arms.

7. The connector defined in claim 6 wherein the formations are transverse projections in the passages.

8. The connector defined in claim 7 wherein each passage has a plurality of the transverse projections spaced angularly and not overlapping axially.

9. The connector defined in claim 1 wherein the wire passages are angularly equispaced about the axis.

10. The connector defined in claim 9 wherein the passages include one central passage at the axis.

* * * * *